US007386915B2

(12) United States Patent
Blocker et al.

(10) Patent No.: US 7,386,915 B2
(45) Date of Patent: Jun. 17, 2008

(54) DUAL MOTOR UPRIGHT VACUUM CLEANER

(75) Inventors: Douglas L. Blocker, Festus, MO (US); John F. Kaido, Arnold, MO (US)

(73) Assignee: Tacony Corporation, Fenton, MO (US)

( * ) Notice: Subject to any disclaimer, the term of this patent is extended or adjusted under 35 U.S.C. 154(b) by 520 days.

(21) Appl. No.: 10/827,704

(22) Filed: Apr. 20, 2004

(65) Prior Publication Data

US 2005/0229356 A1 Oct. 20, 2005

(51) Int. Cl.
*A47L 5/30* (2006.01)

(52) U.S. Cl. ..... 15/331; 15/334; 15/335; 15/412; 15/422.2

(58) Field of Classification Search ..... None
See application file for complete search history.

(56) References Cited

U.S. PATENT DOCUMENTS

| | | | | |
|---|---|---|---|---|
| 1,611,786 | A | | 12/1926 | Serva |
| 2,019,895 | A | | 11/1935 | Dow |
| 2,218,035 | A | | 10/1940 | Benson |
| 4,225,999 | A | | 10/1980 | Martinec et al. |
| 4,231,133 | A | | 11/1980 | Probost |
| 4,397,060 | A | | 8/1983 | Jinkins et al. |
| 4,996,737 | A | * | 3/1991 | Madru, Sr. ..... 15/366 |
| 5,054,157 | A | | 10/1991 | Werner et al. |
| 5,134,752 | A | | 8/1992 | Shipman |
| 5,345,650 | A | | 9/1994 | Downham et al. |
| 5,893,194 | A | | 4/1999 | Karmel |

* cited by examiner

*Primary Examiner*—David A Redding
(74) *Attorney, Agent, or Firm*—Senniger Powers LLP

(57) ABSTRACT

An upright vacuum cleaner having dual cleaning motor and fan units is provided having a cleaning head engagable with a floor and a suction nozzle and a brush roller rotatably mounted therein. A first motor and fan unit is mounted in the vacuum cleaner for producing suction in the suction nozzle and is operatively connected to the brush roller for rotating it. An upright housing is connected to the cleaning head, the housing having a handle for moving the vacuum cleaner along the floor during floor cleaning use. Contained in the housing are a dirt storage container, a passageway leading from the suction nozzle in the cleaning head to the storage container and a second motor and fan unit operatively associated with the storage container for drawing dirt laden air from the cleaning head through the passageway and into the storage container simultaneously with operation of the first motor and fan unit.

11 Claims, 12 Drawing Sheets

DUAL MOTOR UPRIGHT VACUUM CLEANER

BACKGROUND OF THE INVENTION

The present invention relates to upright vacuum cleaners and, more particularly, to an upright vacuum cleaner having a floor cleaning nozzle and an above-floor cleaning nozzle and two motor and fan units as vacuum sources.

Upright vacuum cleaners that utilize two motor and fan units for providing sources of suction are known where one motor and fan unit draws air through the walls of a dirt collection bag, or the like, commonly called a clean air motor, and a second motor and fan unit is disposed in the cleaning head of the vacuum cleaner through which dirt laden air passes, commonly called a dirty air motor. However, some of these prior art vacuum cleaners turn one motor and fan unit off when the other is on since they are used for different purposes. Typically, the clean air motor and fan unit is used for off the floor cleaning with accessories for cleaning furniture and draperies and the like, whereas the dirty air motor and fan unit is used for floor cleaning, such as disclosed in U.S. Pat. No. 4,225,999. In addition, in some known prior art vacuum cleaners where there is utilized simultaneously both motor and fan units, there is also utilized a third motor for driving the brush roller in the cleaning head, such as is disclosed in U.S. Pat. No. 5,134,752. In known prior art vacuum cleaners where there is utilized simultaneously both motor and fan units the operator can not selectively turn one of the motor and fan units off, if desired, for cleaning different surfaces.

SUMMARY OF THE INVENTION

In a preferred embodiment of the present invention, an upright vacuum cleaner is provided having a cleaning head engagable with a floor and a suction nozzle and a brush roller rotatably mounted therein; a first motor and fan unit mounted in the vacuum cleaner for producing suction in the suction nozzle and operatively connected to the brush roller for rotating it; an upright housing connected to the cleaning head, the housing having a handle for moving the vacuum cleaner along the floor during floor cleaning use, a dirt storage container, a passageway leading from the suction nozzle in the cleaning head to the storage container and a second motor and fan unit mounted in the housing and operatively associated with the storage container for drawing dirt laden air from the cleaning head through the passageway and into the storage container simultaneously with operation of the first motor and fan unit.

In addition, a preferred embodiment of the present invention may include an at least partially flexible cleaning hose having a passageway in communication with the housing passageway and having a second suction nozzle at one end thereof. A preferred embodiment may further include a flow cut-off member mounted in the housing passageway so as to close off the passageway leading from the suction nozzle in the cleaning head to the storage container housing passageway when the second nozzle is being utilized, the flow cut-off member being positioned so that the hose passageway stays in communication with the storage container when the second nozzle is utilized. A further flow cut-off switch may also be provided for turning off the first motor and fan unit while still allowing the second motor and fan unit to operate.

It is also an aspect of some embodiments of the present invention that the first and second motor and fan units operate to move substantially the same amount of air simultaneously, and preferably in the range of 80-200 CFM (cubic feet per minute) and more preferably in the range of 95-105 CFM. Alternative, in some embodiments of the present invention it is preferable that the first motor and fan unit produces a lower suction pressure than the second motor and fan unit.

In a further aspect in some embodiments of the present invention the first motor and fan unit preferably produces suction in the range of 10-40 IOW (inches of water) and the second motor and fan unit produces suction in the range of 50-120 IOW, and more preferably the first motor and fan unit produces suction in the range of 20-30 IOW and the second motor and fan unit produces suction in the range of 60-100 IOW.

In a still further aspect of some embodiments of the present invention an upright vacuum cleaner is provided having a cleaning head engagable with a floor and having a suction nozzle and a brush roller rotatably mounted therein; a first motor and fan unit mounted in the vacuum cleaner for producing suction in the suction nozzle; an upright housing connected to the cleaning head, the housing having a handle for moving the vacuum cleaner along the floor during floor cleaning use, a dirt storage container, a passageway leading from the suction nozzle in the cleaning head to the storage container; a second motor and fan unit mounted in the housing and operatively associated with the storage container for drawing dirt laden air from the cleaning head through the passageway and into the dirt storage container simultaneously in series with operation of the first motor unit; an at least partially flexible cleaning hose having a passageway in communication with the housing passageway and having a second suction nozzle at one end thereof; the housing having a holster for receiving the second nozzle when not in use; and a flow cut-off member mounted in the housing passageway so as to close off the passageway leading from the suction nozzle in the cleaning head to the storage container housing passageway when the second nozzle is being utilized, the flow cut-off member being positioned so that the hose passageway stays in communication with the storage container when the second nozzle is utilized.

In yet further embodiments of the present invention, an upright vacuum cleaner is provided having a cleaning head engagable with a floor and having a suction nozzle and a brush roller rotatably mounted therein; an upright housing connected to the cleaning head, the housing having a handle for moving the vacuum cleaner along the floor during floor cleaning use, a dirt storage container, a passageway leading from the suction nozzle in the cleaning head to the dirt storage container; a dirty air motor and fan unit mounted in the vacuum cleaner including a dirty air motor, a first fan mounted in the passageway through which the dirty air passes from the suction nozzle, the first fan having an outlet through which the dirty air passes into the passageway toward the dirt storage container, the dirty air motor and fan unit also having a second fan operatively associated with the dirty air motor which passes cooling clean air through the dirty air motor to cool it; and a clean air motor and fan unit mounted in the housing and having a clean air motor and a clean air fan having a suction inlet operatively associated with the dirt storage container for drawing dirt laden air from the cleaning head through the passageway and into the dirt storage container and for drawing clean air from the dirt storage container simultaneously in series with operation of the dirty air motor and fan unit.

In yet other embodiments of the present invention an upright vacuum cleaner is provided having a cleaning head engagable with a floor and having a suction nozzle and a brush roller rotatably mounted therein; an upright housing connected to the cleaning head, the housing having a handle for moving the vacuum cleaner along the floor during floor cleaning use, a dirt storage container, a passageway leading from the suction nozzle in the cleaning head to the dirt storage container; a dirty air motor and fan unit mounted in the vacuum cleaner including a dirty air motor, a dirty air fan mounted in the passageway through which the dirty air passes from the suction nozzle, the dirty air fan having an outlet through which the dirty air passes into the passageway toward the dirt storage container; and a clean air motor and fan unit mounted in the housing and having a clean air motor and a clean air fan having a suction inlet operatively associated with the dirt storage container for drawing dirt laden air from the cleaning head through the passageway and into the dirt storage container and for drawing clean air from the dirt storage container; and a switch operatively associated with the clean and dirty air motor and fan units to allow manual selection of operating only the clean air motor and fan unit or both the clean and dirty air motor and fan units together to draw dirt laden air from the suction nozzle of the cleaning head.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various aspects all without departing from the invention. Accordingly, the drawings and descriptions will be regarded as illustrative in nature and not as restrictive.

DETAILED DESCRIPTION OF THE PREFERRED EMBODIMENT

Figure 1:
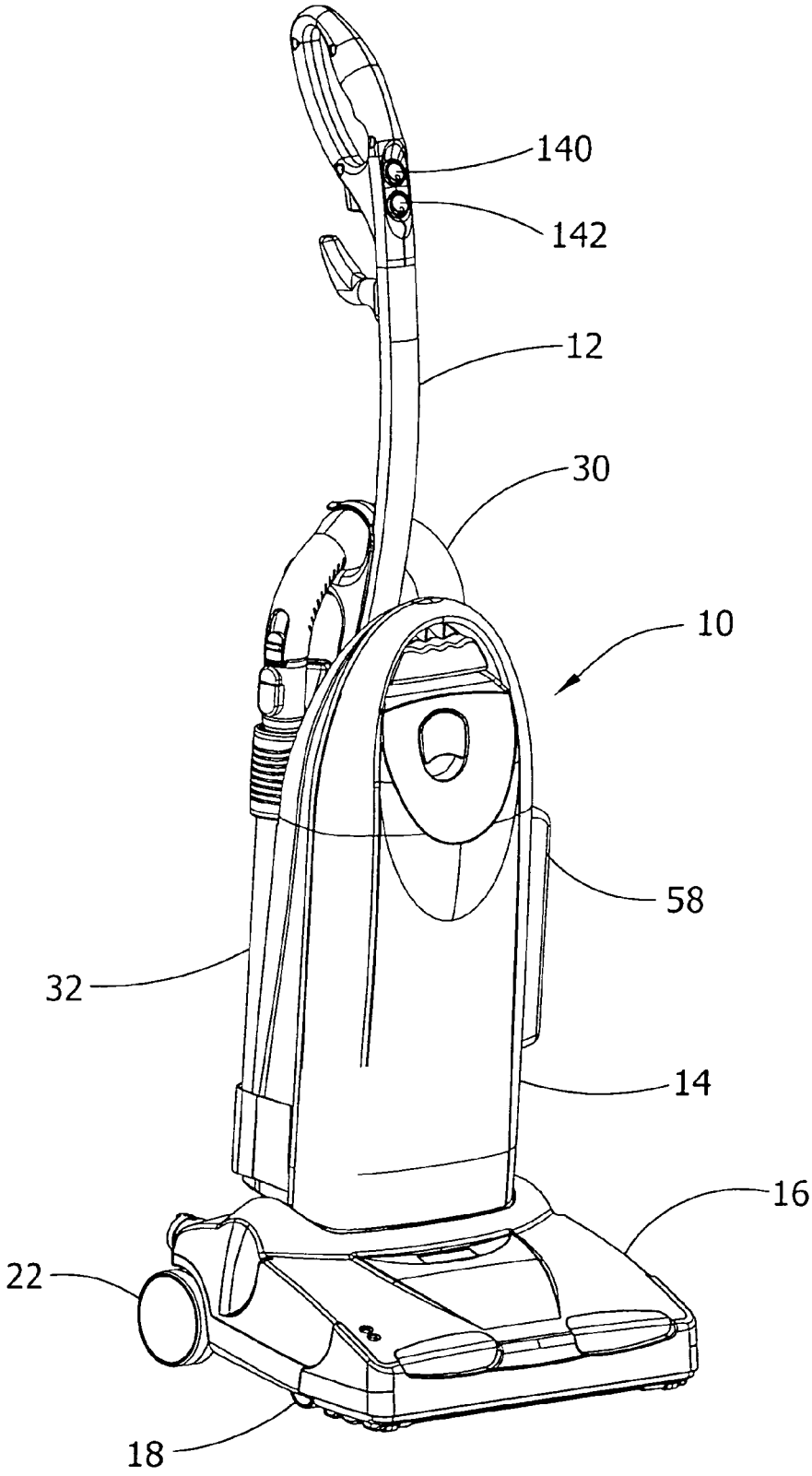
FIG. 1 is a front pictorial view of a preferred embodiment of the present invention.
Figure 2:
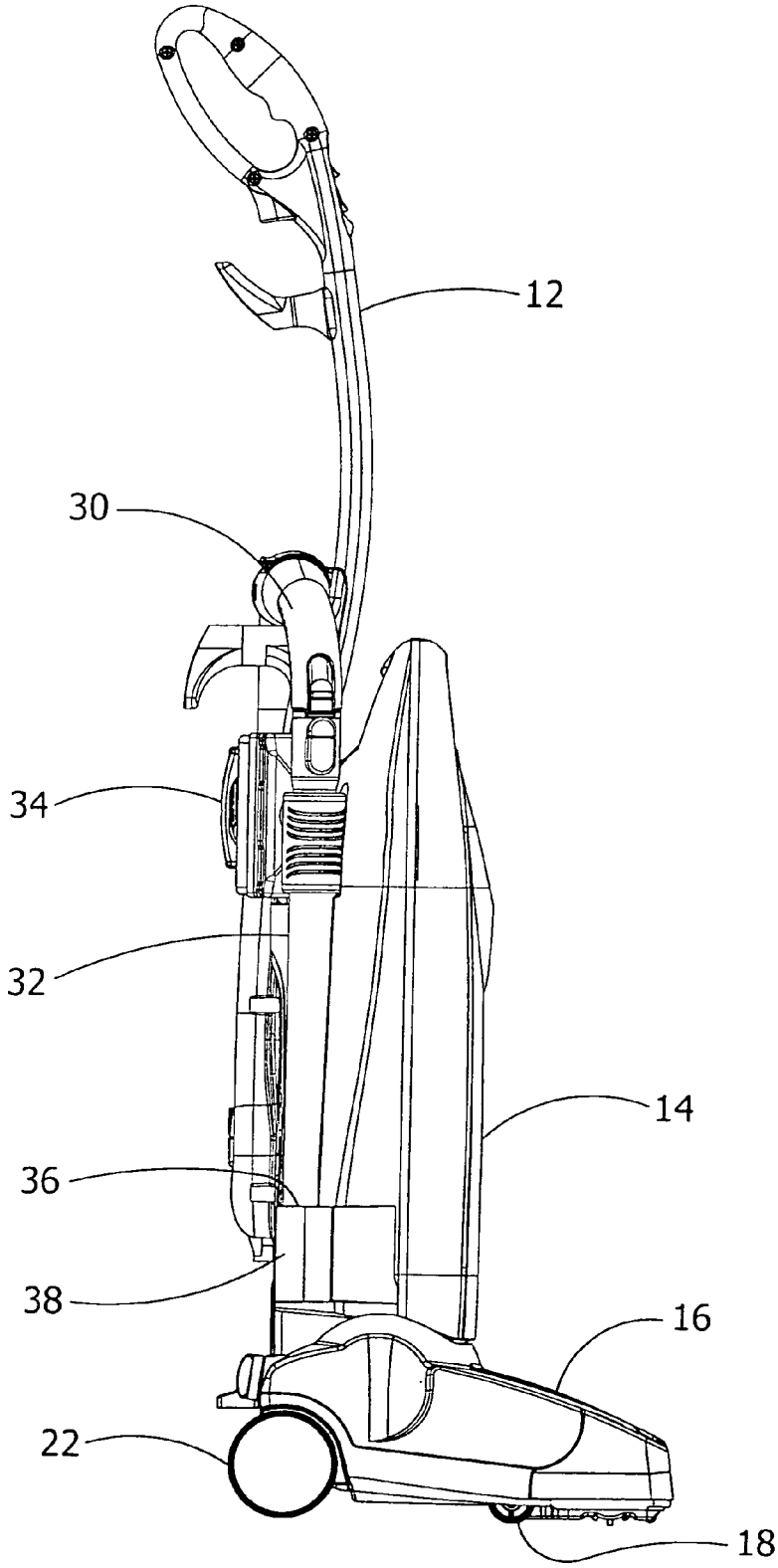
FIG. 2 is a right side view of the preferred embodiment.
Figure 3:
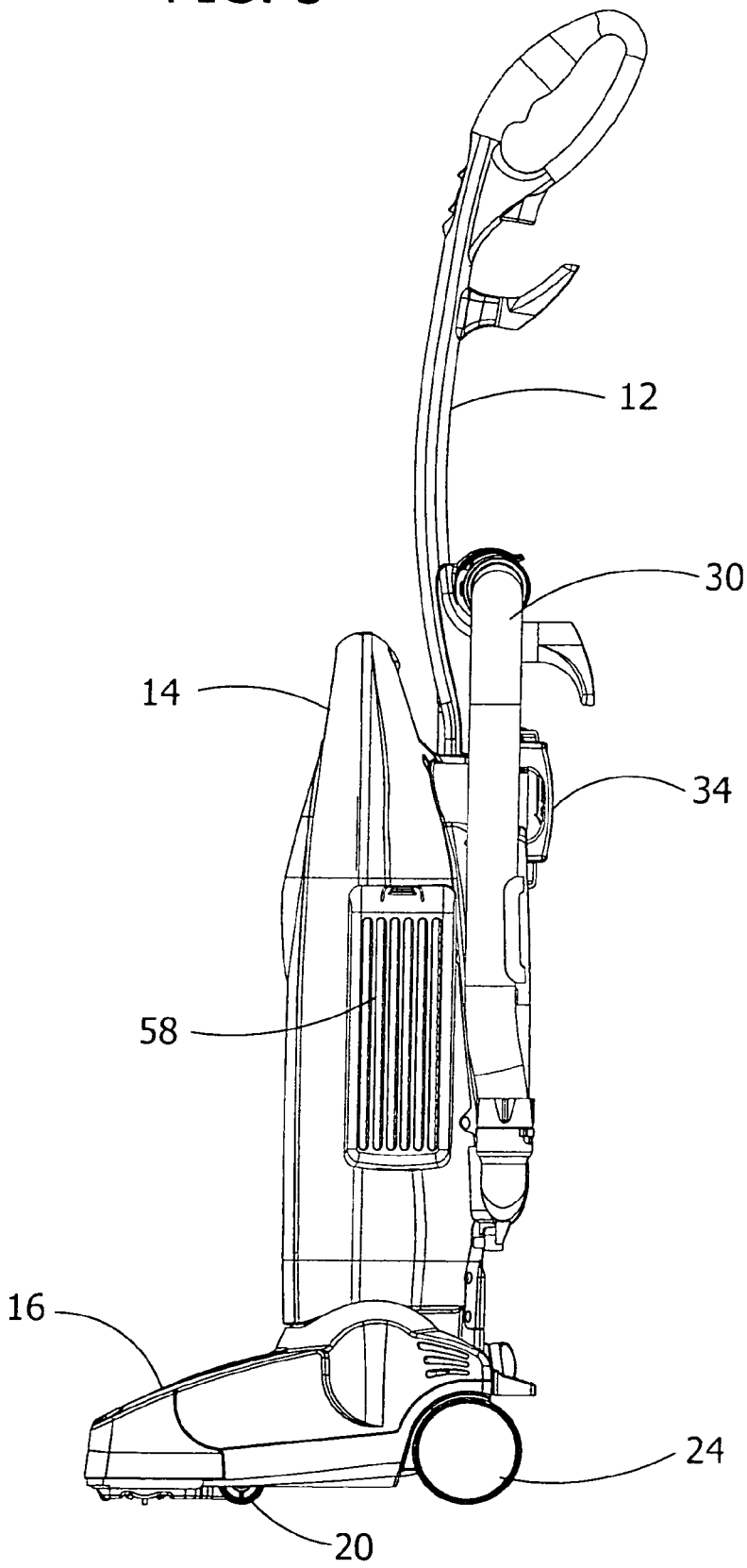
FIG. 3 is a left side view of the preferred embodiment.
Figure 4:
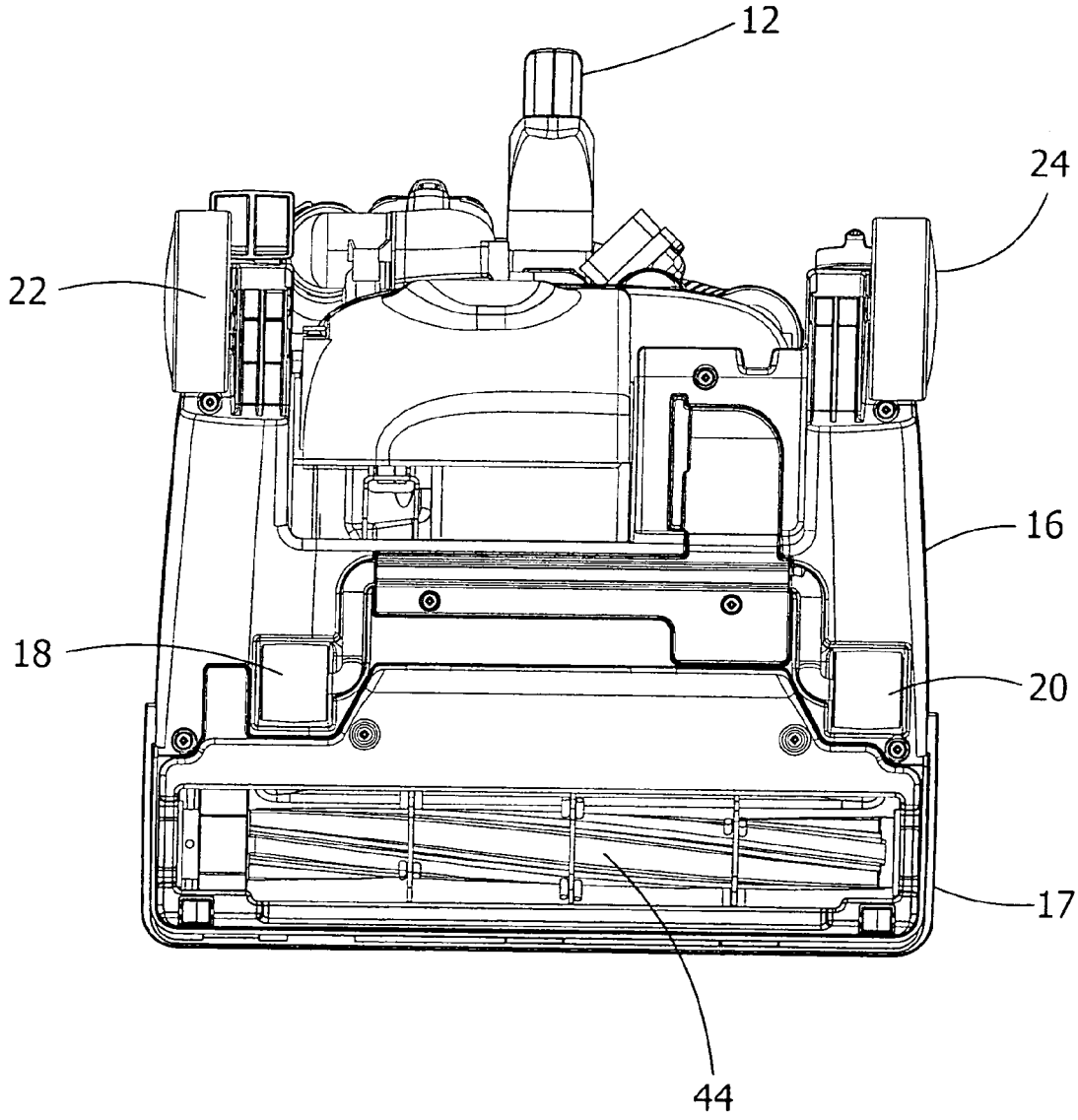
FIG. 4 is a bottom view of the preferred embodiment.

Referring to FIG. 1, an upright vacuum cleaner 10, constituting a preferred embodiment of the present invention, is shown having a handle 12 extending out of and connected to an upright housing 14. The housing 14 is pivotally connect to a cleaning head 16 so that the handle 12 can be pivoted between a generally horizontal position to a generally vertical position, as is generally well known in the art, in order to maneuver the cleaning head 16 over a surface to be cleaned. The vacuum cleaner 10 is supported by a pair of front wheels 18 and 20 (see FIGS. 2, 3 and 4) and a pair of back wheels 22 and 24.

A partially flexible cleaning hose 30 is attached to the back of the housing 14 and carries a nozzle 32 (see FIG. 5) for above-floor cleaning. Removably carried on the back of housing 14 are above-floor cleaning attachments 34 which are adapted to be fitted to the end 36 of nozzle 32 for cleaning various above-floor surface configurations and materials in a well known manner. The outer end 36 of nozzle 32 is removably received in a holster 38 formed in the back of the housing 14 for storage of the nozzle 32 when not in use. The holster 38 is essentially a sleeve which receives the outer end 36 of nozzle 32.

Figure 7:
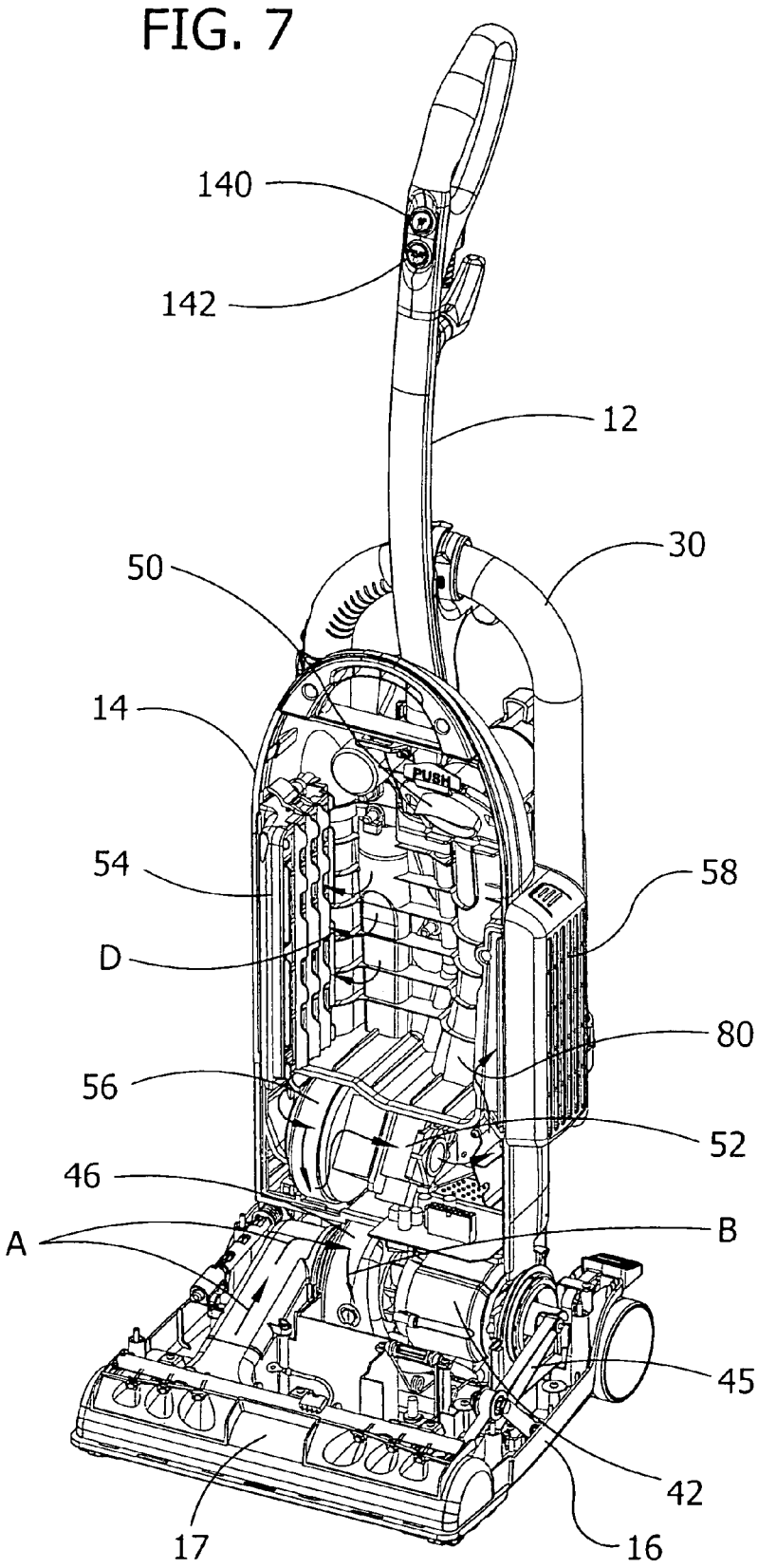
FIG. 7 is a front pictorial view with some covers and other parts removed to show internal parts of the preferred embodiment.

With reference to FIG. 7, a portion of an airflow path within the vacuum cleaner 10 is illustrated with several sets of arrows showing the direction of air flow. The preferred embodiment of the vacuum cleaner 10 has two motor and fan units which produce suction in the air flow passageways described below. A first suction motor and fan unit 42 and its associated air flow passageway is positioned in the upright housing 14 near the cleaning head 16. First motor and fan unit 42 draws dirty air in the direction of arrows A from the nozzle portion 17 of the cleaning head 16 surrounding the beater bar 44 (see FIG. 4). The dirty air from nozzle portion 17 is drawn through a spiral housing 46 containing an impeller driven by motor and fan unit 42. The air flows through the spiral housing 46 in the direction of arrows B as shown in FIG. 7. The air then flows up into a duct 48 (see FIG. 8) formed in the rear portion of housing 14. Duct 48 extends up the housing 14 and opens into the top of a dirt storage container 49 which is mounted to the flange 50 concealed within the housing 14. Dirt storage container 49 is of conventional construction and is made of sufficiently porous material to allow air to pass through it but retain dirt in the container. Air flow through duct 48 and into the dirt storage container 49 is shown by arrows C. Motor and fan unit 42 also drives brush roll 44 through a drive belt 45 extending between pulleys on an end of the motor drive shaft and an end of the brush roll support shaft.

A second motor and fan unit 52 (see FIG. 7) is mounted in the lower portion of housing 14 and draws clean air out through the porous walls of dirt storage container 49 through a filter 54 as shown by arrows D, and causes a suction in duct 48 as a result of the air being drawn from dirt storage container 49 which, in turn, draws dirty air from the nozzle portion 17 of cleaning head 16. The air being drawn from dirt storage container 49 by motor and fan unit 52 flows through a cylindrical housing 56 containing fan blades, as discussed in more detail below, and is then expelled outside the housing 14 through a filter 58. As a general matter, all of the ducts and air flow passages associate with both motor and fan unit systems are preferably substantially air tight and are provided with seals where necessary to provide an essentially air tight flow path for clean and dirty air through the vacuum cleaner 10.

The fans of the two motor and fan units 42 and 52 can be any one of several standard designs such that they permit the proper flow of air through the system passageways. In the case of motor and fan unit 42, the fan must be able to allow the dirty air to pass through it without suffering substantial damage over time. It is believed squirrel-cage fans and impeller type fans are just a couple of well known fan types that can be used in one or both of the motor and fan units 42 and 52. The motor and fan units used in the preferred embodiment are discussed in further detail below.

The air flow of the two motor and fan units 42 and 52 is preferably about the same so that air flow from one motor and fan unit does not interfere with the air flow of the other. In this situation the air flow produced by the two motor and fan units is preferably in the range of 80-200 CFM (cubic feet per minute) and more preferably in the range of 95-105 CFM. In a further aspect, in some embodiments of the present invention the first motor and fan unit 42 preferably produces suction in the range of 10-40 IOW (inches of water) and the second motor and fan unit 52 preferably produces suction in the range of 50-120 IOW, and more preferably the first motor and fan unit 42 produces suction in the range of 20-30 IOW and the second motor and fan unit 52 produces suction in the range of 60-100 IOW.

Alternatively, the suction caused by motor and fan unit 52 can be greater than that of motor and fan unit 42 so that the suction of motor and fan unit 52 assists in drawing air from motor and fan unit 42 into the dirt storage container 49.

Figure 5:
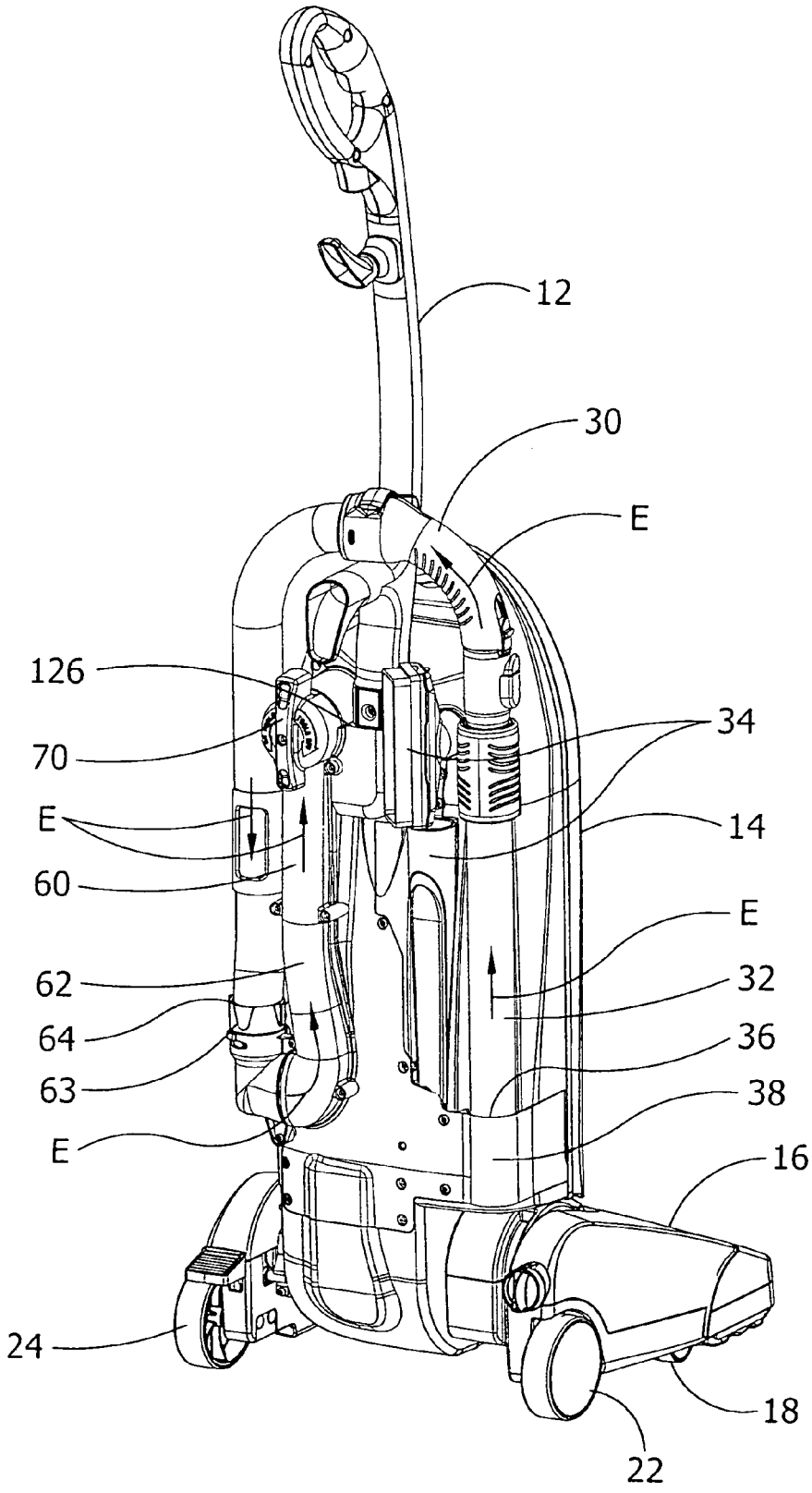
FIG. 5 is a rear pictorial view of the preferred embodiment.
Figure 6:
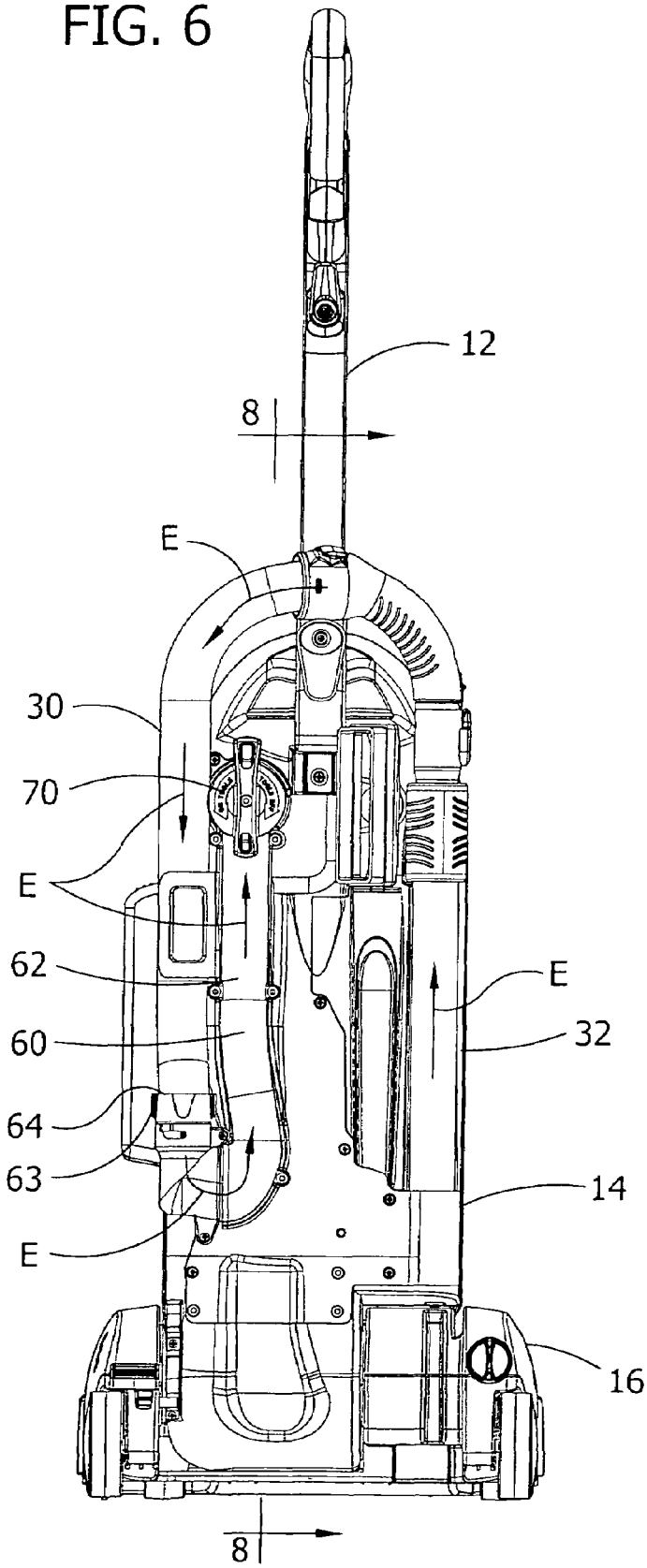
FIG. 6 is a rear view of the preferred embodiment.
Figure 8:
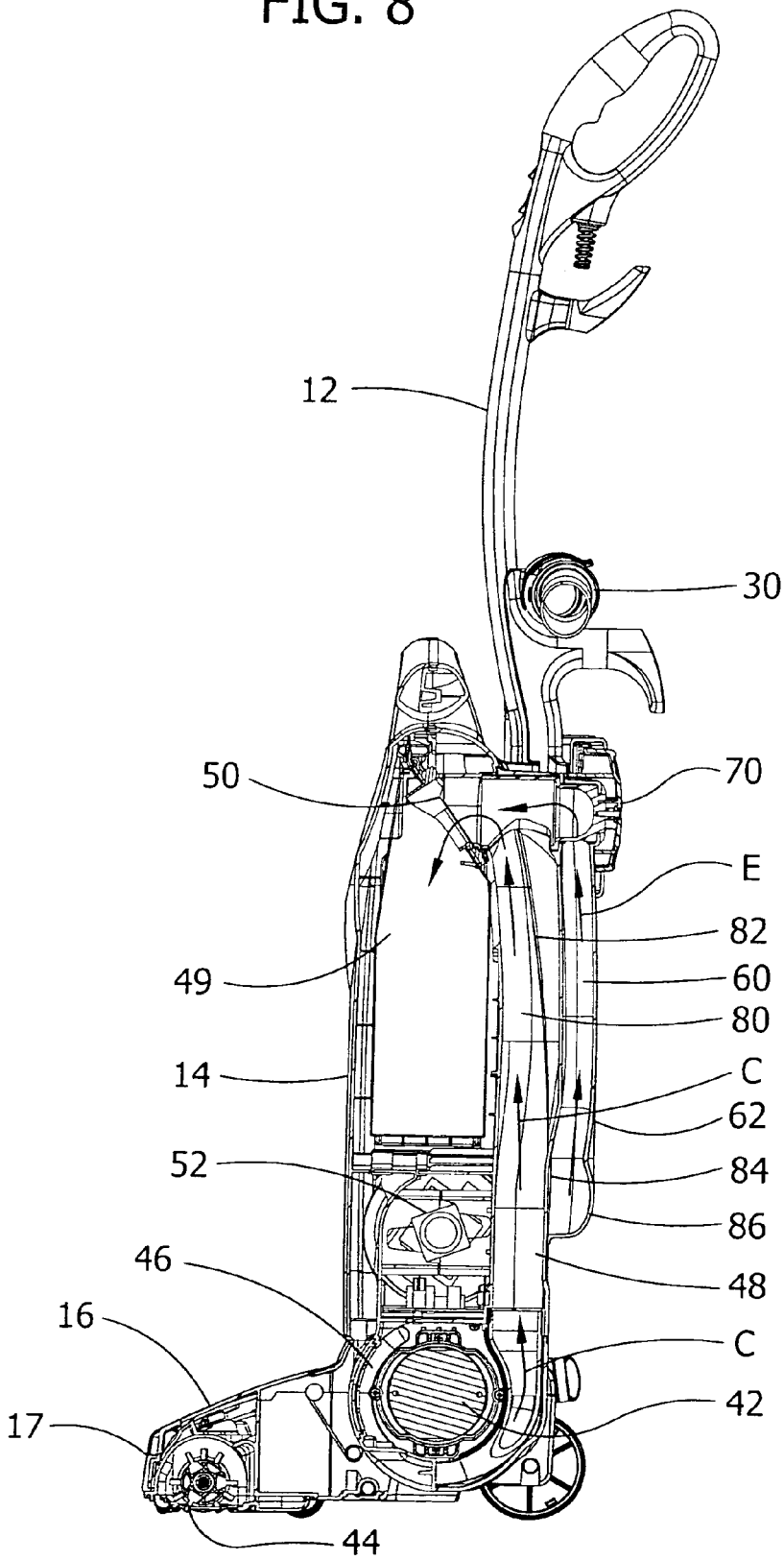
FIG. 8 is a cross-sectional view along line 10-10 of FIG. 6.

FIGS. 5, 6 and 8, show a duct 60 which allows air to flow in the direction of arrows E from the nozzle 32 of cleaning hose 30 to a vacuum source flow direction control valve 70. A portion of duct 60 is formed along the outer rear surface of the vacuum cleaner housing 14 by a conduit 62 which extends up the back of the housing. Conduit 62 extends from an attachment point 63 (see FIG. 6) of the end 64 of flexible cleaning hose 30 to the vacuum source flow direction control valve 70.

Referring again to the duct 48 that allows air to flow from the cleaning head 16 to dirt storage container 49, it includes a conduit 80 (see FIG. 8), also formed in the back of the housing 14 of the vacuum cleaner, running parallel to and inward of conduit 62 from the lower portion of the housing in communication with the floor cleaning nozzle 17 in the cleaning head 16, up to the control valve 70. Control valve 70 is used to manually change the air flow path into the dirt storage container 49 between the cleaning head 16 and the cleaning hose 30. In a first position, the control valve 70 allows air to flow from the cleaning head 16 into the dirt storage container 49 while shutting off air flow from the cleaning hose 30 to the dirt storage container 49. In a second position, the control valve 70 allows air to flow from the cleaning hose 30 into the dirt storage container 49 while shutting off air flow from the cleaning head 16 to the dirt storage container 49.

Figure 9:
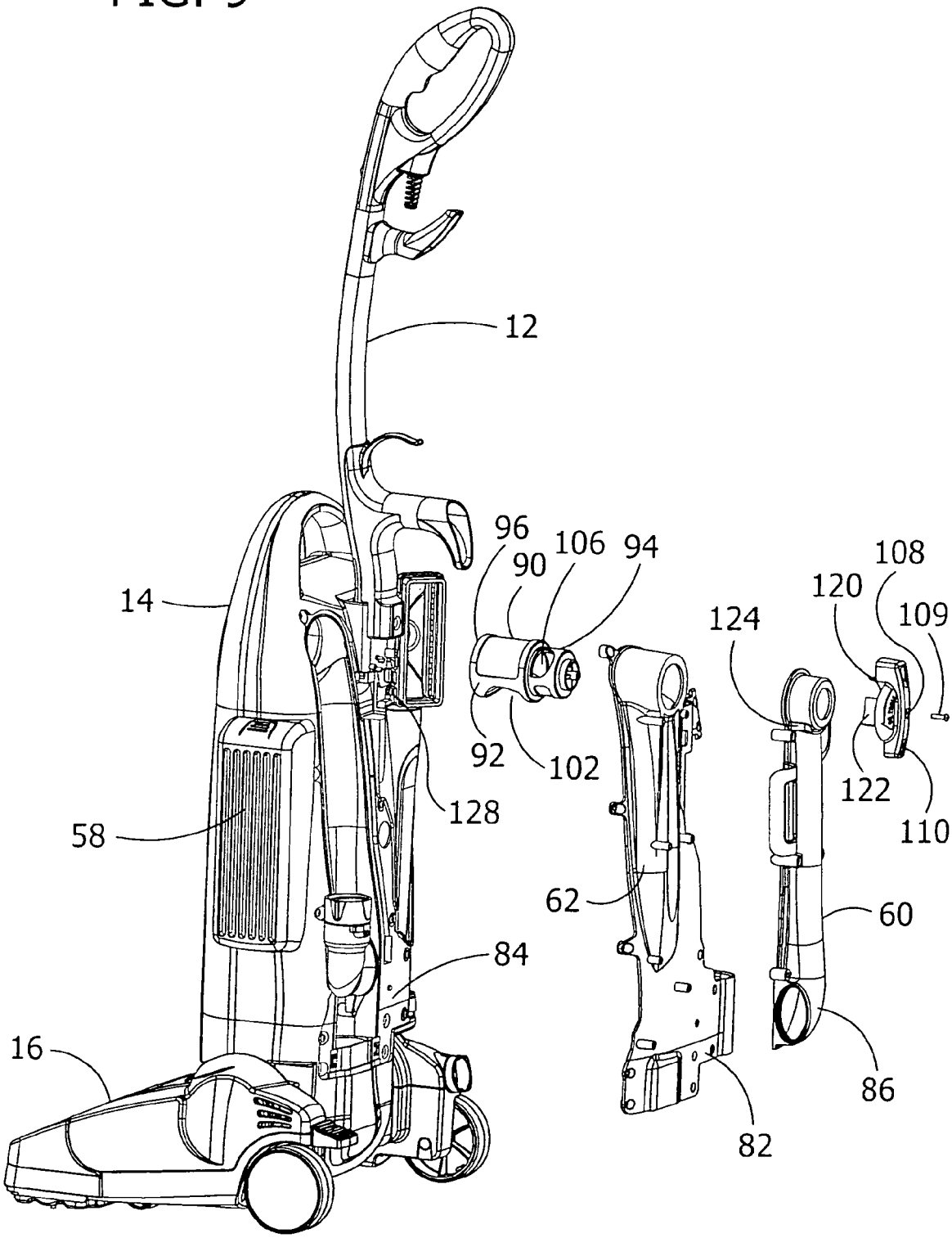
FIG. 9 is an expanded pictorial view showing portions of the air flow passage ways and flow control valve in the back of the preferred embodiment.

Referring to FIGS. 8 and 9, duct 60 is formed between an inner wall 82 secured, such as by screws, to the back panel 84 forming the back of the housing 14 of the vacuum cleaner, and an outer wall 86 secured, such as by screws, to the back panel 84. The back panel 84 and the inner wall 82 are internally configured to form conduit 80, which is a portion of duct 48, coming from the cleaning head 16 to the control valve 70.

Figure 10:
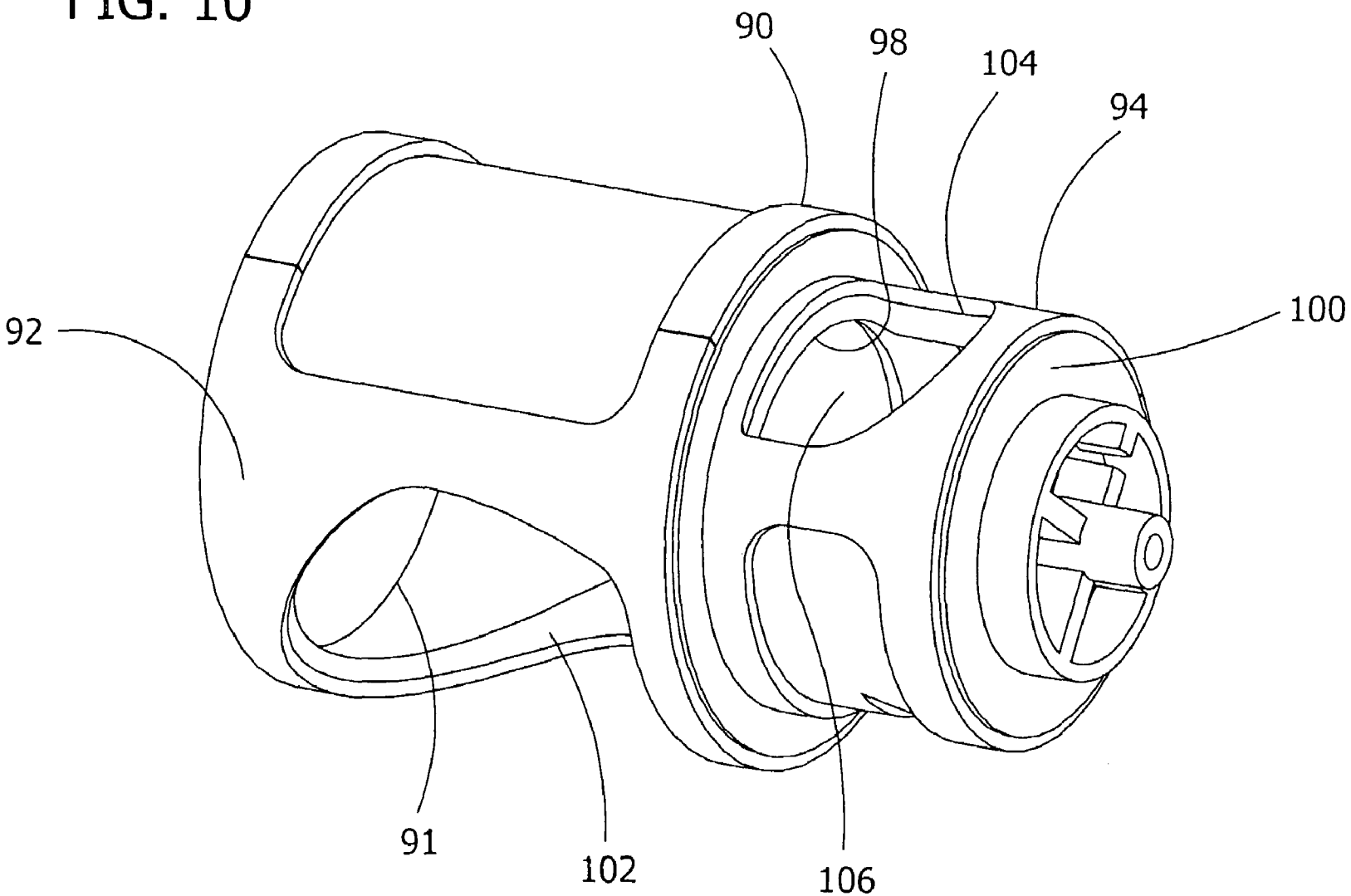
FIG. 10 is an enlarged pictorial view of the valve body of the flow control valve of the preferred embodiment.
Figure 11:
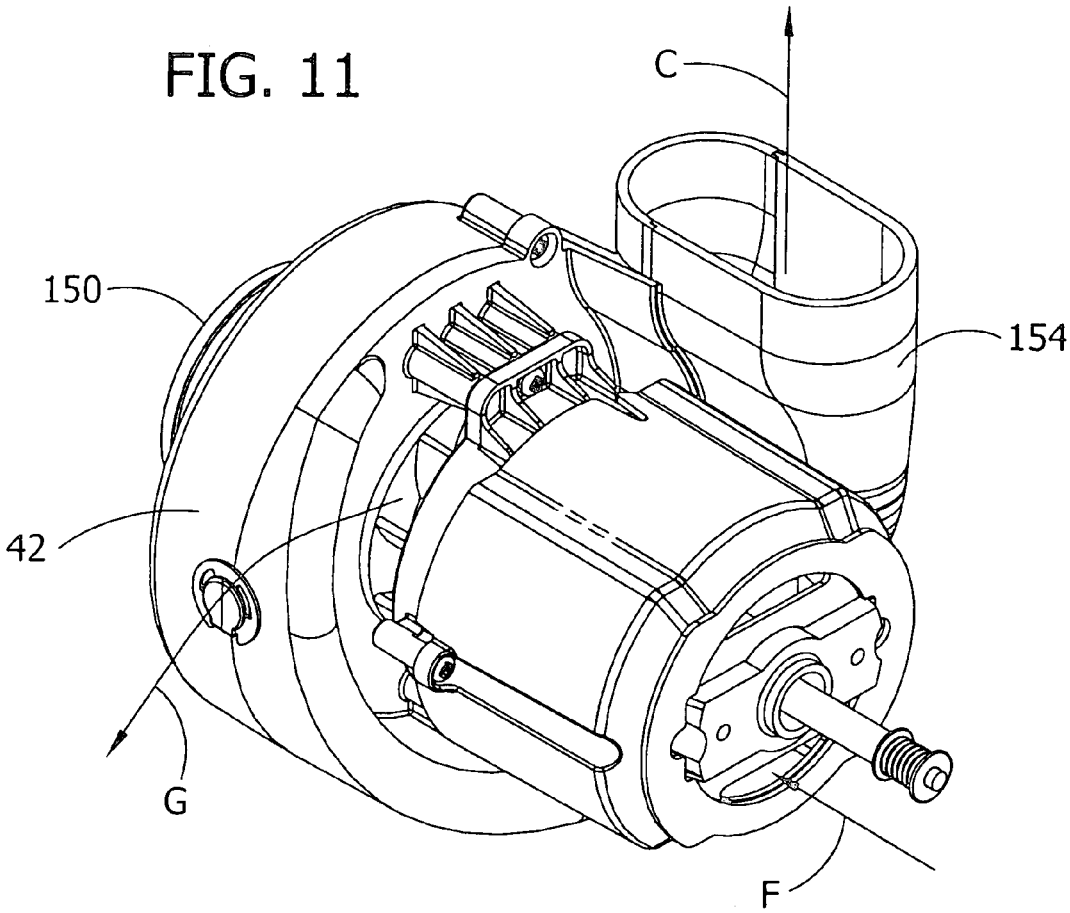
FIG. 11 is a pictorial view of the dirty air motor utilized in the preferred embodiment of the present invention.
Figure 12:
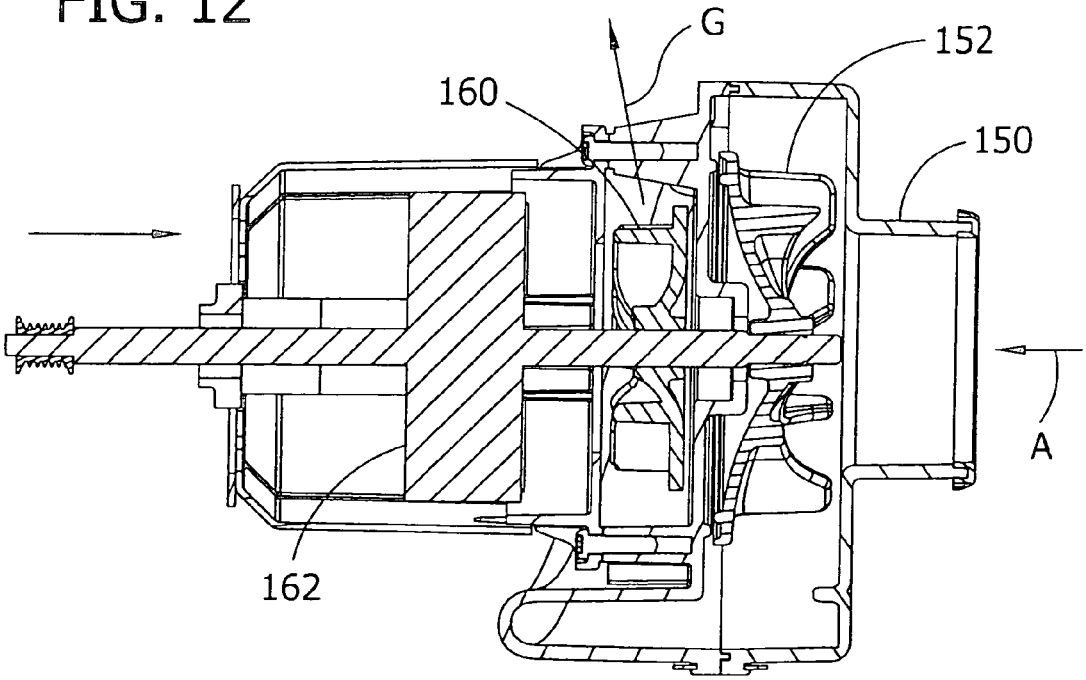
FIG. 12 is a cross-sectional view of the motor of FIG. 11.

As shown in FIGS. 8, 9 and 10, control valve 70 includes a generally cylindrical valve body 90 having a larger cylindrical portion 92 and a smaller cylindrical portion 94, as shown in FIGS. 9 and 10. One end 96 of valve body 90 is provided with an opening. In a preferred embodiment, the end 96 of cylindrical portion 92 is completely open with the opening being defined by the cylindrical wall 91 of body portion 92. An opposite end 98 of cylindrical body portion 92 is also open and, in the preferred embodiment, this opening is defined by the transition in the internal walls of the larger cylindrical portion 92 and the smaller cylindrical portion 94, as best seen in FIG. 10. The outer end 100 of smaller cylindrical portion 94 is closed off.

In the outer cylindrical wall 91 (see FIG. 10) an opening 102 is defined which can be aligned with duct 48 (see FIG. 8) when the valve body 90 is properly positioned. The cylindrical wall 104 of smaller cylindrical portion 94 defines an opening 106 which, when properly positioned, can be aligned with duct 60. Opening 106 is offset circumferentially from opening 102 so that when opening 102 is aligned with duct 48 opening 106 is out of alignment with conduit 60 and vise versa. In a preferred embodiment, openings 102 and 106 are approximately 130 degrees circumferentially offset from one another. The outer end 100 of smaller cylindrical portion 94 is fitted to receive a manually rotatable cap 108 having a grip 110. The valve body 90 is fitted for rotation in the housing 14 of the vacuum cleaner. The larger cylindrical portion 92 is mounted for rotation with its open end 96 received in the back panel 84 and its opposite end in an opening in wall 82. Cylindrical seals (not shown) are mounted in the panel 84 and wall 82 to prevent leakage around the ends of the larger cylindrical portion 92. The smaller cylindrical portion 94 of valve body 90 is mounted for rotation within the outer wall 86 and a cylindrical seal (not shown) prevents leakage from around the outer end of valve body 90.

Cap 108 is fixedly secured, such as by a screw 109 (see FIG. 9), to the outer end 100 of valve body 90 for rotation therewith. Grip 110 is formed by two generally rectangular cross-sectioned extensions on the top of cap 108 which can be easily grabbed with fingers to rotate the cap 108 and thus valve body 90. Two arcuate extensions 120 and 122 (see FIG. 9) are formed as extensions of the plastic cap 108. Arcuate extensions 120 and 122 (see FIG. 9) act as stops for rotation of cap 108 and valve body 90 by engaging shelves 124 (see FIG. 9) and 126 (see FIG. 5), respectively, formed in the outer surface of outer wall 86, at each end of the rotational movement of cap 108. In addition, arcuate extension 122 engages a micro switch 128 fixed in the rear panel of the housing 14 of the vacuum cleaner 10 when extension 122 engages shelf 126. Switch 128 turns on motor and fan unit 42 when engaged by extension 122 and turns off motor and fan unit 42 when extension 122 is rotated out of engagement with switch 128, subject to the position of other switches described below.

Referring again to FIG. 1, two switches, 140 and 142 are mounted in handle 12. The two switches are connected to a printed circuit board (not shown) which controls operation of the two motor and fan units 42 and 52. Switch 140 is an on/off switch which turns the two fan and motor units 42 and 52 on or off when pressed under certain conditions and comprises a master switch for turning the vacuum cleaner 10 on and off. If the handle 12 is in the upright position as shown in FIG. 1 and switch 140 is activated, the circuit will only turn on motor and fan unit 52 and not motor and fan unit 42 since motor and fan unit 42 would operate the beater bar 44 which could damage flooring that the vacuum cleaner is setting on and since, with the handle in the upright position, it is likely that the nozzle 32 will be utilized for above floor cleaning. If handle 12 is moved out of the up right position a switch 144 (see FIG. 6) positioned in the housing and engaging cleaning head 16 will send a signal to the circuit that will allow the first motor and fan unit 42 to also be activated when switch 140 and 142 are activated since putting the handle in other than the upright position usually indicates that nozzle 17 in cleaning head 16 will be utilized to clean flooring. Switch 142 can be utilized to turn motor and fan unit 42 on or off when the handle 12 is not in the upright position so that, for example, cleaning head 16 can be utilized to clean flooring that might be damaged by brush roll 44.

Referring more particularly to the two motor and fan units 42 and 52, as shown respectively in FIGS. 11 and 12, and 13 and 14, motor and fan unit 42 will be referred to as a dirty air motor and fan unit since air directly from the nozzle portion 17 of cleaning head 16 passes directly through it, and motor and fan unit 52 will be referred to as a clean air motor since air which is sucked into it passes through the dirt storage container 49 which acts as a filter to clean the air before it passes through it. The dirty air motor and fan unit 42 receives air from nozzle portion 17 (see arrows A in FIG. 7) through cylindrical inlet 150. The dirt laden air then axially enters suction fan 152 which expels the air at its periphery through a spiral housing 154 into duct 48 from which it passes into the dirt storage container 49. Although the fan 152 may take any one of many forms, it must be sufficiently sturdy and so formed as to withstand the impact of dirt laden air for prolonged periods of use. In addition, in the preferred embodiment, the motor and fan unit 42 is provided with a second fan 160 which is axially aligned with the first fan 152. Fan 160 is provided to cool the motor 162 which drives the two fans 152 and 160. Cooling fan 160 has a separate air intake 164 that is isolated from the dirty air flow path associated with fan 152 so that clean air, as shown by arrow F, flows through the motor 162 to cool it. The air which is sucked through the motor by fan 160 is then exhausted through outlets 166 around the periphery of the casing of motor 162 as shown by arrows G.

Figure 13:
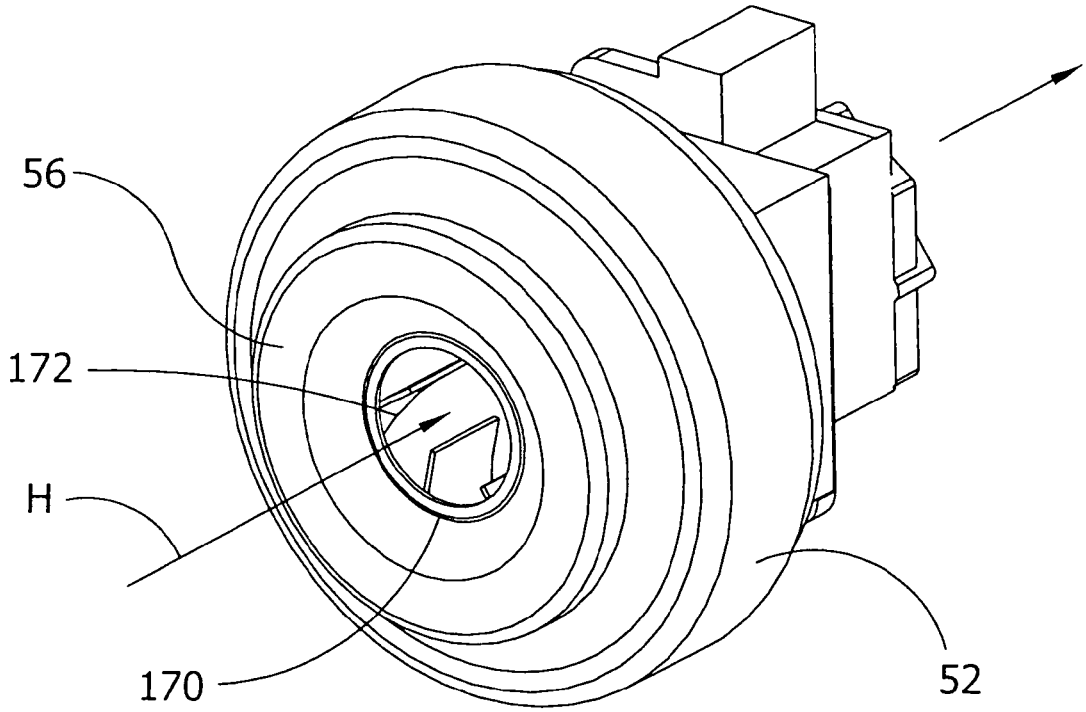
FIG. 13 is a pictorial view of the clean air motor utilized in the preferred embodiment of the present invention.
Figure 14:
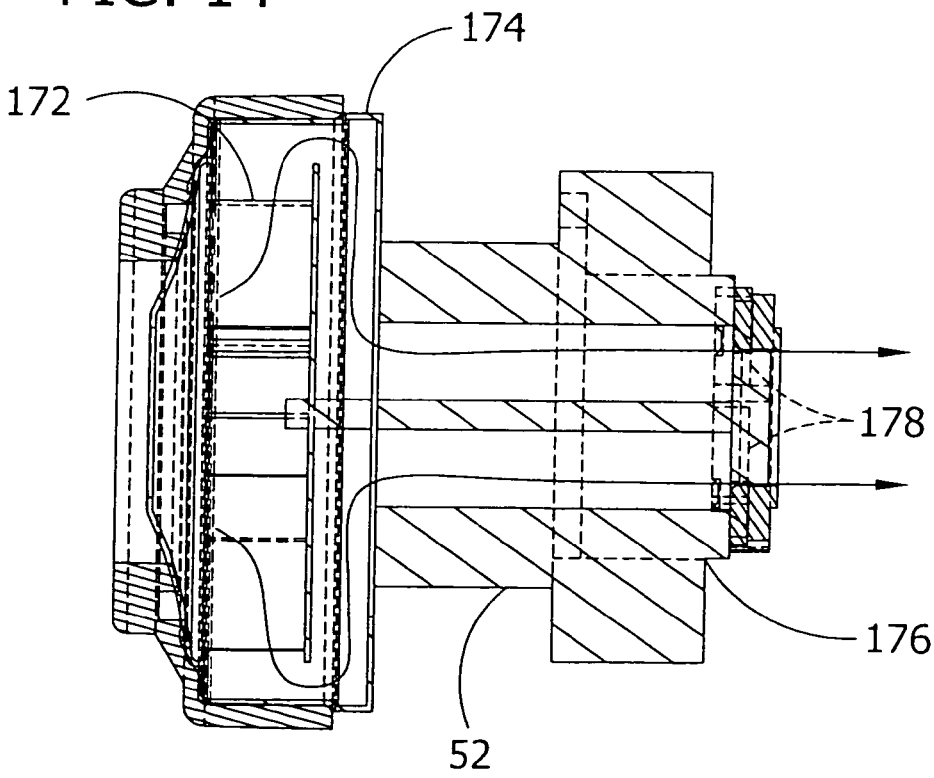
FIG. 14 is a cross-sectional view of the motor of FIG. 13.

Referring to the clean air motor and fan unit 52, as shown in FIGS. 13 and 14, clean air enters the fan 160 through an axial opening 170, as shown by arrows H, in cylindrical housing 56 from air filter 54. The air is drawn in through opening 170 by fan 172 and is then radially expelled from the periphery of fan 172 to pass inside the motor housing 174 and through motor 176 to cool it. The air then leaves the motor 176 through a series of exit holes 178 and is expelled through duct work which directs the air toward filter 58 by the pressure created by fan 172. Since the clean air motor and fan unit 52 only has clean air passing through it, its internal construction and arrangement need not be as sturdy as the dirty air motor and fan unit 42. In addition, in the preferred embodiment, since clean air is being drawn into the clean air motor and fan unit 52, that air can be used to cool the motor, as described above, rather than having a separate fan for cooling the motor.

When the vacuum cleaner 10 is being used as an upright vacuum to clean floors, both motor and fan units 42 and 52 are preferably operated simultaneously to provide maximum suction so that air is drawn up through cleaning head 16 (see FIG. 7) through motor and fan unit 42 and up through duct 48 and into the dirt storage container 49 through its mounting flange 50. During this operation valve 70 is manually positioned, as shown in FIGS. 6 and 8, to allow dirty air to pass from duct 48 through opening 102 in valve body 90 and then out through the opening in end 96 of valve 90 as shown by the arrows in FIG. 8. With valve 90 in this position, duct 60 is closed off by wall portion 94 of valve 90 so that there is no suction force on duct 60 and thus no air is drawn through flexible cleaning hose 30.

When it is desired to use cleaning hose 30, valve 90 is manually rotated counter-clockwise until the extension 120 engages stop 124 formed in the side of outer wall 86. Moving the valve to this position aligns opening 104 in valve 90 so that air can flow from hose 30 through duct 60 and valve 90 into dirt storage container 49 through its mounting flange 50.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An upright vacuum cleaner, comprising:

a cleaning head engagable with a floor and having a suction nozzle and a brush roller rotatably mounted therein;

a first motor and fan unit mounted in the vacuum cleaner for producing suction in the suction nozzle and operatively connected to the brush roller for rotating it;

an upright housing connected to the cleaning head, the housing having a handle for moving the vacuum cleaner along the floor during floor cleaning use, a dirt storage container, a passageway leading from the suction nozzle in the cleaning head to the dirt storage container; and a second motor and fan unit mounted in the upright housing and operatively associated with the dirt storage container for drawing dirt laden air from the cleaning head through the passageway and into the dirt storage container simultaneously with operation of the first motor and fan unit, wherein the first and second motor and fan units operate to move substantially the same amount of air simultaneously in the range of 80-200 CFM.

2. The vacuum cleaner of claim 1, wherein the first and second motor and fan units move air simultaneously in the range of 95-105 CFM.

3. The vacuum cleaner of claim 1, wherein the first motor and fan unit produces a lower suction pressure than the second motor and fan unit.

4. The vacuum cleaner of claim 3, wherein the first motor and fan unit produces suction in the range of 10-40 IOW and the second motor and fan unit produces suction in the range of 50-120 IOW.

5. The vacuum cleaner of claim 3, wherein the first motor and fan unit produces suction in the range of 20-30 IOW and the second motor and fan unit produces suction in the range of 60-100 IOW.

6. The vacuum cleaner of claim 1, wherein the first motor and fan unit is connected to the brush roller by means of a first pulley mounted for rotation on an output shaft of the first motor, a second pulley mounted for rotation on the brush roller and a drive belt interconnecting the two pulleys.

7. The vacuum cleaner of claim 1 wherein the dirt storage container includes a filter bag in communication with the passageway and the second motor and fan unit are outside of the filter bag and draw air through it.

8. An upright vacuum cleaner, comprising:

a cleaning head engagable with a floor and having a suction nozzle and a brush roller rotatably mounted therein;

a first motor and fan unit mounted in the vacuum cleaner for producing suction in the suction nozzle and operatively connected to the brush roller for rotating it;

an upright housing connected to the cleaning head, the housing having a handle for moving the vacuum cleaner along the floor during floor cleaning use, a dirt storage container, a passageway leading from the suction nozzle in the cleaning head to the dirt storage container; and a second motor and fan unit mounted in the upright housing and operatively associated with the dirt storage container for drawing dirt laden air from the cleaning head through the passageway and into the dirt storage container simultaneously with operation of the first motor and fan unit; and an at least partially flexible cleaning hose having a passageway in communication with the housing passageway and having a second suction nozzle at one end thereof.

9. The vacuum cleaner of claim 8, including:

a flow cut-off member mounted in the housing passageway positionable so as to close off the passageway leading from the suction nozzle in the cleaning head to the storage container housing passageway when the second nozzle is being utilized, the flow cut-off member being positionable so that the hose passageway stays in communication with the dirt storage container when the second nozzle is utilized.

10. An upright vacuum cleaner, comprising:

a cleaning head engagable with a floor and having a suction nozzle and a brush roller rotatably mounted therein;

a first motor and fan unit mounted in the vacuum cleaner for producing suction in the suction nozzle and operatively connected to the brush roller for rotating it;

an upright housing connected to the cleaning head, the housing having a handle for moving the vacuum cleaner along the floor during floor cleaning use, a dirt storage container, a passageway leading from the suction nozzle in the cleaning head to the dirt storage container; and a second motor and fan unit mounted in the upright housing and operatively associated with the dirt storage container for drawing dirt laden air from the cleaning head through the passageway and into the dirt storage container simultaneously with operation of the first motor and fan unit; and a cut-off switch for turning off the first motor and fan unit while still allowing the second motor and fan unit to operate.

11. An upright vacuum cleaner, comprising:

a cleaning head engagable with a floor and having a suction nozzle and a brush roller rotatably mounted therein;

a first motor and fan unit mounted in the vacuum cleaner for producing suction in the suction nozzle and operatively connected to the brush roller for rotating it;

an upright housing connected to the cleaning head, the housing having a handle for moving the vacuum cleaner along the floor during floor cleaning use, a dirt storage container, a passageway leading from the suction nozzle in the cleaning head to the dirt storage container; and a second motor and fan unit mounted in the upright housing and operatively associated with the dirt storage container for drawing dirt laden air from the cleaning head through the passageway and into the dirt storage container simultaneously with operation of the first motor and fan unit, wherein the first motor and fan unit is mounted in the upright housing.

* * * * *